United States Patent [19]

Ballard

[11] Patent Number: 4,580,380

[45] Date of Patent: Apr. 8, 1986

[54] COMPOSITE FILLED INTERIOR STRUCTURAL BOX BEAMS

[76] Inventor: Derryl R. Ballard, Rte. 1, 69B, Trenton, Tex. 75490

[21] Appl. No.: 549,278

[22] Filed: Nov. 7, 1983

[51] Int. Cl.[4] ..... E04C 3/30

[52] U.S. Cl. ..... 52/309.9; 52/731

[58] Field of Search ..... 52/309.9, 731, 785, 52/792, 802, 806, 809

[56] References Cited

U.S. PATENT DOCUMENTS

| | | | |
|---|---|---|---|
| 3,224,154 | 12/1965 | Toti et al. | 52/731 |
| 3,238,690 | 3/1966 | Wilkins | 52/731 |
| 3,540,116 | 7/1967 | Drahos et al. | 52/809 |
| 3,810,337 | 5/1974 | Pollard | 52/731 |

*Primary Examiner*—Norman Morgenstern
*Assistant Examiner*—Ken Jaconetty
*Attorney, Agent, or Firm*—Warren H. Kintziner

[57] ABSTRACT

A composite beam built up in box form of four metal members, two flanges and two webs, that in some applications are of different thicknesses. The flanges and webs are cold roll formed light gauge aluminum or steel, or in extruded form, and the hollow box shape is filled with a structural honeycomb or foamed plastic, or an alternate lightweight bulk space-filling substance. The four metal members are two pairs of duplicate members formed and bonded around a core with staking or peening operations accomplished during beam box forming assembly.

6 Claims, 10 Drawing Figures

COMPOSITE FILLED INTERIOR STRUCTURAL BOX BEAMS

Figure 1:
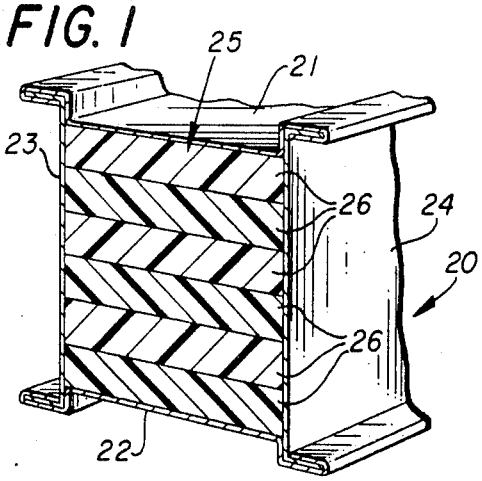

This invention relates in general to structural beams and, in particular, to a lightweight, low cost, high strength-to-weight ratio composite beam built up of two flange and two web members in box form and filled with a lightweight spacefilling bulk substance.

In relatively light building construction relatively long ceiling or floor beams running to some fifteen–twenty feet or more in length are desirable, with such beams being relatively light in weight and aesthetically appealing to the eye. Such beams are normally supported at their ends, with it important that they be relatively rigid in support of loads applied at intermediate points along the beam. Solid wooden beams and steel or other metal "I" or "T" beams, while satisfactory and actually required for many purposes, are not as properly suited for installations where lightweight, low cost and high strength-to-weight ratios are important. Further, the aesthetic consideration is important in many installations with finish use from pre-coated stock treated in a number of ways-varied colors or wood grain surfacing or other surfacing being facilitated with applicant's new structural box beams.

It is, therefore, a principal object of this invention to provide a lightweight structural beam having a relatively high strength-to-weight ratio of fabricated box construction.

Another object of the invention is to provide a fabricated box beam made up from two pairs of duplicate members for ease of construction and uniformity of product.

A further object with such a box beam is to provide aesthetically appealing fabricated box beams fabricated from pre-coated pre-finished stock.

Still another object is optimization of strength-to-weight ratios in such box beams through use of thicker flanges than webs and/or use of stronger material flanges than webs.

Features of this invention useful in accomplishing the above objects include, in a fabricated composite structural box beam, buildup of beams from four generally planar members that are in the form of two pairs, a pair of flange members and a pair of web members, that may be of different thicknesses and/or different materials. The flange and web members are, for some box beams, cold roll formed from steel and light gauge aluminum or extruded aluminum, or various combinations thereof. The composite box beams are of hollow box shape, filled with a honeycomb structure of paper, metal or plastic, or a fibrous substance, or a foamed plastic. The flange and web members are assembled in a combination forming and glue bonding operation bonding them around a core enclosed within the assembled flanges and webs, with flange edge material fold formed over web flange turned edges and staked or lanced.

Specific embodiments representing what are presently regarded as the best modes of carrying out the invention are illustrated in the accompanying drawings.

Figure 2:
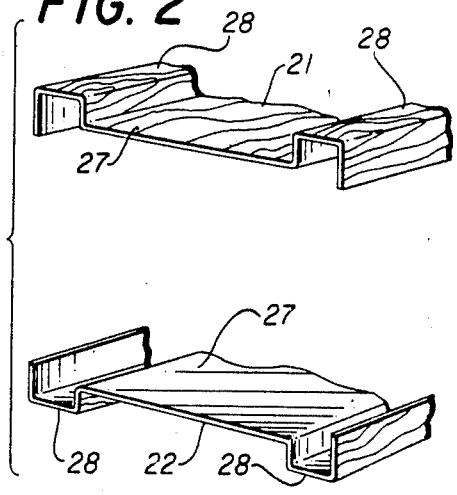
Figure 3:
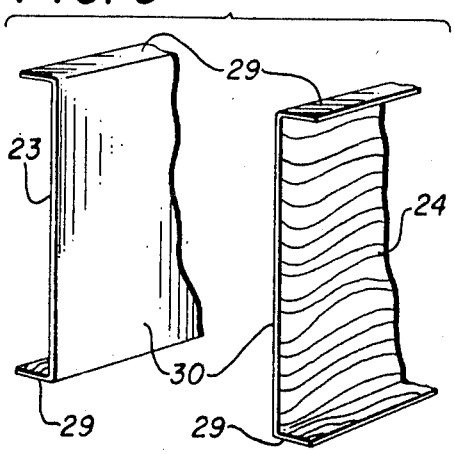
Figure 4:
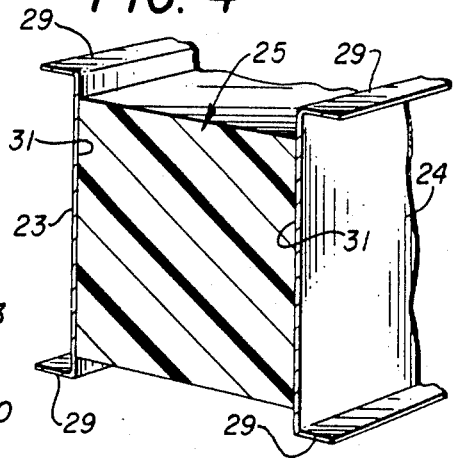
Figure 5:
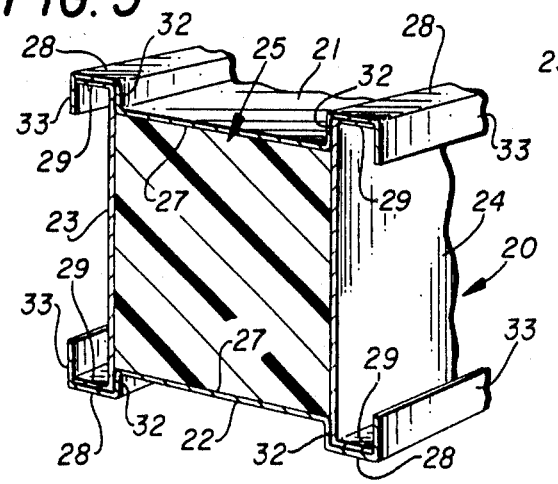
Figure 6:
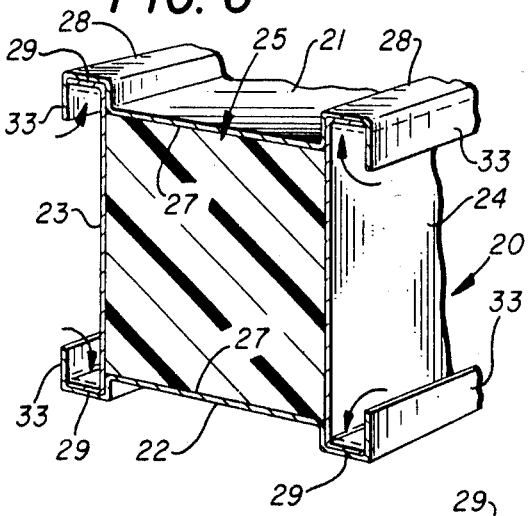
Figure 7:
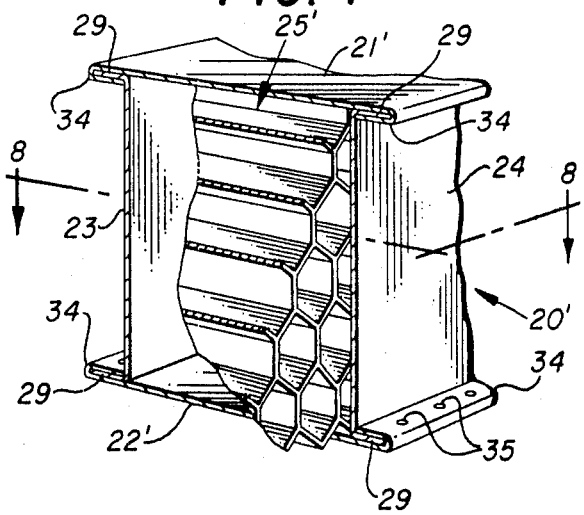
Figure 8:
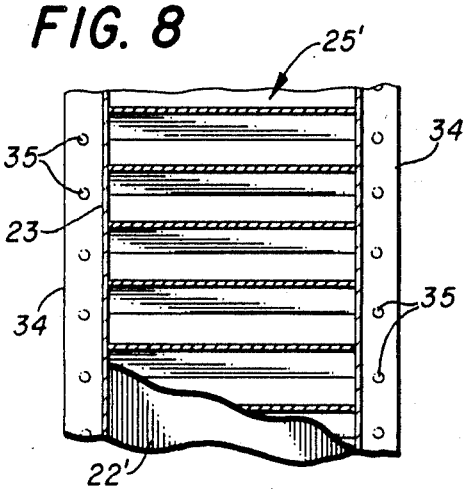
Figure 9:
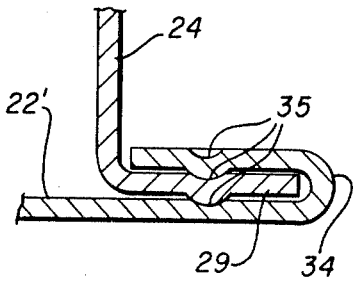
Figure 10:
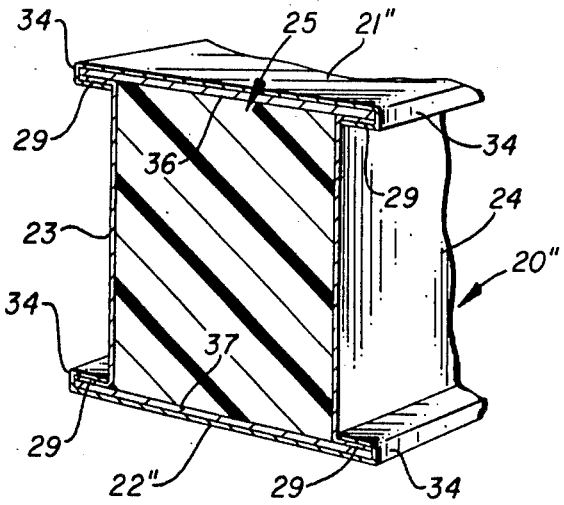

In the drawings:

FIG. 1 represents a partial perspective view of a composite box beam showing a beam end with foamed plastic slab material enclosed within the box beam;

FIG. 2, a partial perspective view of a pair of upper and lower flange members for the box beam of FIG. 1;

FIG. 3, a partial perspective view of a pair of webs for the box beam of FIG. 1;

FIG. 4, an end view of a pair of webs of FIG. 3 glued to opposite sides of a foamed plastic slab material core in the construction of the composite box beam of FIG. 1;

FIG. 5, an end view of the box beam in the next stage of construction with upper and lower flanges glue bonded in place;

FIG. 6, an end view of the box beam in the final stage of construction with the flange edge extension formed over and staked to web edge flanges;

FIG. 7, an end view of another box beam embodiment with straight flat upper and lower flanges;

FIG. 8, a partial cut away view looking down from line 8—8 in FIG. 7 showing beam and lower flange to web staking detail;

FIG. 9, a partial enlarged end view showing additional flange edge to web edge foldover and staking detail; and, FIG. 10, an end view of another box beam embodiment with sheet metal tension and compression planks added to the interior of upper and lower flanges as a part of strengthened flanges.

Referring to the drawings:

The composite box beam 20 of FIG. 1 is shown to be constructed of an upper flange member 21 and lower flange member 22 that, as a pair, are duplicates of each other, a pair of duplicate web members 23 and 24 that interconnect the flange members 21 and 22 in box form enclosing a foamed plastic material core 25, that in this instance is made up of a plurality of foamed plastic planks 26. The flanges 21 and 22 and webs 23 and 24 in the pre-assembled form of FIGS. 2 and 3, respectively, are in such form cold roll formed from steel and light gauge aluminum or extruded aluminum, or various combinations thereof. The flanges 21 and 22 and webs 23 and 24 for many applications are also provided with a pre-coat of paint or finish such as the wood grain finish contact paper applied to outer surfaces, as shown in FIGS. 2 and 3. Further, the flanges 21 and 22 are identical duplicates with a center formed channel 27 extending the longitudinal length thereof, with a flange edge extension 28 at each side shaped to be formed over respective web edge flanges 29.

Referring also to FIG. 4, the inside surface 30 of the body of webs 23 and 24 is glued 31 to opposite sides of plastic material core 25. Please note that core 25 could be a foamed-in-place foamed plastic core in place of the multi foamed plastic plank core of FIG. 1, a honeycomb structure of paper, metal or plastic such as the honeycomb core 25' of the FIGS. 7–9 embodiment, or a fibrous substance filled core. Next in the fabrication process (with reference to FIG. 5) the flanges 21 and 22 may in like manner be glued to the top and bottom of core 25 and/or to the portions of webs, particularly the web edge flanges 29 as by glue strips 32. Thereafter, as shown in FIG. 6, the edge extensions 28 of flanges 21 and 22 have edge portions 33 that are formed over to the state indicated in phantom to enclose respective web edge flanges 29 with composite box beam 20 then in the completed fabricated product state ready for structural use.

With the composite box beam 20' of FIGS. 7–9, the upper and lower flanges 21' and 22' are shown as being straight, flat upper and lower flanges, duplicates one of the other, without channels, with the side edges 34 thereof folded over respective edge flanges 29 of webs 23 and 24. While core 25′ of box beam 20′ is shown as being a honeycomb core, any other core such as described hereinafter may be used in place thereof. Furthermore, an additional assembly staking 35 detail indicated in FIGS. 8 and 9 in the flanges 21′ and 22′, flange side edges 34 and web edge flanges 29 may also be used in other embodiments hereof.

The composite box beam 20″ embodiment of FIG. 10 has an additional beneficial feature over the other embodiments in that metal tension and compression longitudinal planks 36 and 37, that may or may not be duplicates of each other, of steel or aluminum, or other structural material, are contained in assembly within the upper and lower flanges 21″ and 22″. Other than for the plank addition and accommodating size variation of the flanges therefor, and variation of or elimination of staking, as with the embodiment of FIGS. 7–9, the FIG. 10 composite box beam 20″ is much the same with much greater strength characteristics as required for many installations.

Please note again that with the various box beams flanges and webs can be of different thicknesses, thereby allowing the flanges to be thicker than the webs because the flanges are the tension and compression members of a beam and make a large contribution to its structural integrity. Usually the webs can be thinner than the flanges, thereby reducing the weight and the cost of the beam. The flanges also, in many instances, are made from steel to give added strength to the beam, and the webs are in some beams made from aluminum to aid in reducing weight. Such combination of advantageous features cannot be accomplished if the flanges and webs are formed from one piece.

Whereas this invention is herein illustrated and described with respect to several specific embodiments thereof, it should be realized that various changes may be made without departing from the essential contribution to the art made by the teachings hereof.

I claim:

1. A rigid elongated lightweight structural composite beam in box form comprising: a pair of spaced separate identically shaped metal beam upper and lower flange members longitudinally extended along said beam, a pair of spaced separate identically shaped rectilinearly extending metal beam web members longitudinally extended along said beam and having identically shaped flange outwardly turned edges; said upper and lower flange members having flange edge material fold formed inwardly and into overlap enclosing tightly engaging relation over respective flange outwardly turned edges of said web members and with the pair of upper and lower flange members in interconnected assembled form with said web members defining the box form of said composite beam; a lightweight space-filling compressible resilient material filling the interior of said composite beam within the box form defined by said pair of upper and lower flange members and said pair of web members; and a separate metal tension and compression plank longitudinally extended along the longitudinal length of said composite beam and spanning said space-filling material adjacent at least one of said upper and lower flange members and adjacent outwardly turned edges of said metal beam web members; said metal plank having its opposite longitudinally extended terminal edges transversly extended beyond the box form of said composite beam with opposite side edges disposed and snugly held between the fold formed turned edges of a flange member and the spaced outwardly turned edges of said web members.

2. The lightweight structural composite beam in box form of claim 1, wherein bonding material is also used to provide an interconnecting material bond between said lightweight space-filling material filling the interior of said composite beams and interior surfaces of at least one pair of the members defining the box form of said composite beam.

3. The lightweight structural composite beam in box form of claim 2, wherein metal deformation fastening is employed at spaced intervals along only one side of each flange to web member longitudinally extended interconnection.

4. The lightweight structural composite beam in box form of claim 3, wherein said metal deformation fastening is in the form of staking.

5. The lightweight structural composite beam in box form of claim 1, wherein said lightweight space-filling material filling the interior of said composite beam is a honeycomb structure.

6. The lightweight structural composite beam in box form of claim 1, wherein said lightweight space-filling material filling the interior of said composite beam is a foamed plastic core.

* * * * *